United States Patent [19]

Iseki

[11] 4,399,632

[45] Aug. 23, 1983

[54] TOY HAVING PLURALITY OF PARTS CAPABLE OF DISENGAGING UPON ROTATION

[75] Inventor: Takeo Iseki, Tokyo, Japan

[73] Assignee: Tomy Kogyo Co., Inc., Tokyo, Japan

[21] Appl. No.: 271,440

[22] Filed: Jun. 8, 1981

[30] Foreign Application Priority Data

Oct. 24, 1980 [JP] Japan ..... 55-151883[U]

[51] Int. Cl.[3] ..... A63H 33/00

[52] U.S. Cl. ..... 46/16; 46/22; 46/47

[58] Field of Search ..... 46/22, 47, 115, 116, 46/123, 124, 145, 248, 269, 17, 16, 1 R, 32; 273/290, 276, 1 GF

[56] References Cited

U.S. PATENT DOCUMENTS

| | | | |
|---|---|---|---|
| 2,068,053 | 1/1937 | Gehman | 46/64 X |
| 2,083,119 | 6/1937 | Hense | 273/110 X |
| 2,996,833 | 8/1961 | Giuliano | 46/22 |
| 3,246,424 | 4/1966 | Gregory | 46/83 X |
| 4,303,240 | 12/1981 | Ellman et al. | 273/1 GF |

FOREIGN PATENT DOCUMENTS

| | | | |
|---|---|---|---|
| 675825 | 12/1963 | Canada | 46/22 |
| 992454 | 5/1965 | United Kingdom | 46/1 R |
| 1376016 | 12/1974 | United Kingdom | 273/1 GF |

OTHER PUBLICATIONS

"Doozies", *Playthings*, p. 94, ©Aug. 1961.

*Primary Examiner*—Mickey Yu
*Attorney, Agent, or Firm*—K. H. Boswell; Edward D. O'Brian

[57] ABSTRACT

A toy has a first member which includes a rotating mechanism at least a portion of which is capable of rotating with respect to the first member about an axis of rotation. A second member is capable of being associated with the first member and being rotated with respect to the first member between a first position wherein the second member is stable with respect to the first member and is supported by the first member and a second position wherein the second member is destabilized with respect to the first member and is capable of becoming disassociated from the first member. A coupling mechanism detachably couples the second member to the rotating portion of the rotating mechanism so as to transfer rotary movement of the rotating portion of the rotation mechanism to the second member to rotate the second member with respect to the first member between the first and second positions. The second member and preferredly a plurality of other members are stacked on the first member and when the second member is caused to rotate with respect to the first member it and the plurality of other members become dislodged from the first member.

9 Claims, 8 Drawing Figures

TOY HAVING PLURALITY OF PARTS CAPABLE OF DISENGAGING UPON ROTATION

BACKGROUND OF INVENTION

This invention is directed to a toy wherein a second member is supported on a first member and upon rotation of the second member with respect to the first member the second member becomes dislodged from the first member.

Spinning toys have been known for centuries and have been fascinating items for children for play purposes. Toys which are capable of rapidly spinning can be imparted with sufficient angular momentum such that their rotation maintains them in an upward position on a hard surface and the like. Because of the manual dexterity required to initiate the spinning of these types of tops, they are generally not suitable for play for small tots and the like. To overcome the manual dexterity problem, tops geared for the toddlers and the like which have a pumpable plunger are known. These allow the child to move the plunger up and down to impart sufficient angular momentum to the top in order to maintain it spinning for a period of time.

For toddlers and the like many toys have been developed which instill eye-hand coordination into the user of the toy. These normally incorporate multiple pieces which fit together by interaction of one piece with the other. These toys in their more preferred form include coupling units of different geometric shapes such that the child soon learns that a square peg does not fit in a round hole, but in fact a round peg fits in a round hole. This helps teach the child concepts of shapes, space, geometry and the like.

Certain top type toys are known which incorporate both a spinning motion and requiring assembly of components. In this category are U.S. Pat. Nos. 2,068,053 and 2,739,415. Unfortunately, the tops described in these patents are geared to the older child having certain manual dexterity skills. Insofar as these tops require activation of the spinning motion by pulling a string or the like, this type of toy is precluded from use by the small child who lacks the necessary manual dexterity skills.

Because of the fascination of just about all age levels of children with spinning toys and the educational values of the type of toy which requires proper placement of parts with respect to one another to build an object, it is deemed that a toy geared to the toddler age group which incorporated both the spinning principle and the structure principle would be highly utilitarian. Tops and the like would not fulfill this need because of the above noted manual dexterity required in the manipulating and winding of strings and the like. Further, the known construction type toys suitable for small children, normally have very loose or sloppy fitting connections and thus are not susceptible to spinning by the child.

BRIEF DESCRIPTION OF THE INVENTION

In view of the above it is a broad object of this invention to provide a toy for the toddler age group which incorporates both the construction type toy principle and the spinning type toy principle. It is a further object to provide a toy which the child can construct from component pieces and then can cause to spin to disassemble the pieces from one another. It additionally is an object to provide a toy which has a mechanism incorporated therein capable of spinning the toy without resorting to the use of strings and other pulling type devices. Additionally, it is an object to provide a toy that, because of its simplicity of engineering, is easy to construct by the manufacturer and thus can be economically produced for the consumer.

These and other objects, as will become evident from the remainder of this specification, are achieved in a toy which comprises: a first member; rotation means associated with said first member, at least a portion of said rotation means capable of rotating with respect to said first member about a first axis of rotation; a second member capable of being associated with said first member and being rotated with respect to said first member between a first position wherein said second member is generally stable with respect to said first member and is supported by said first member and a second position wherein said second member is destabilized with respect to said first member and is capable of disassociating from said first member; coupling means detachably coupled said second member to said rotating portion of said rotation means so as to transfer rotary movement of said rotating portion of said rotation means to said second member to rotate said second member with respect to said first member between said first and said second positions.

In the preferred embodiment of the invention, the second member will have its own axis of rotation and one of the first or the second members will include a means associated with it which would be capable of inclining the axis of rotation of the second member with respect to the axis of rotation of the rotating portion of the rotary means when the second member is in the second position. When the axis of rotation of the second member is so inclined when the second member is in the second position, the second member would be unstable with respect to the first member and would be susceptible to being dislodged from the first member.

The means to cause such an inclination of the axis of rotation of the second member in its preferred form would preferredly include one of the first or the second members having an inclined surface. This inclined surface would serve as a connecting surface between the first and the second members. In an even more preferred form of the toy, both the first and the second members would have an inclined surface. When the second member is in the first position with respect to the first member, the inclined surfaces interact with one another such that the axis of rotation of the second member is coincidental with the axis of rotation of the rotating portion of the rotating means. When the second member is in the second position, the surfaces interact such that the axis of rotation of the second member becomes inclined with respect to the axis of rotation of the rotating portion of the rotating means.

Said rotation means preferredly includes a rotating element rotatably mounted in said first member and an activation means operatively connected to the rotating element to rotate the rotating element with respect to the first member. Upon activation of the activation means by the child using the toy, rotation of the rotating element would cause the second member to rotate from the first position to the second position.

Preferredly, the coupling means comprises a reentrant connection between the rotating element and the second member. In the illustrative embodiment, the reentrant means comprises the rotating element including a key projecting from the rotating element and the second member including a wall having a slot shaped to accept the key. The wall fits over the rotating element thus forming a connection between the second member and the rotating element and the key interacts with the slot to propagate the rotary movement of the rotating element to the second member.

BRIEF DESCRIPTION OF THE DRAWINGS

This invention will be better understood when taken in conjunction with the drawings wherein.

Figure 1:
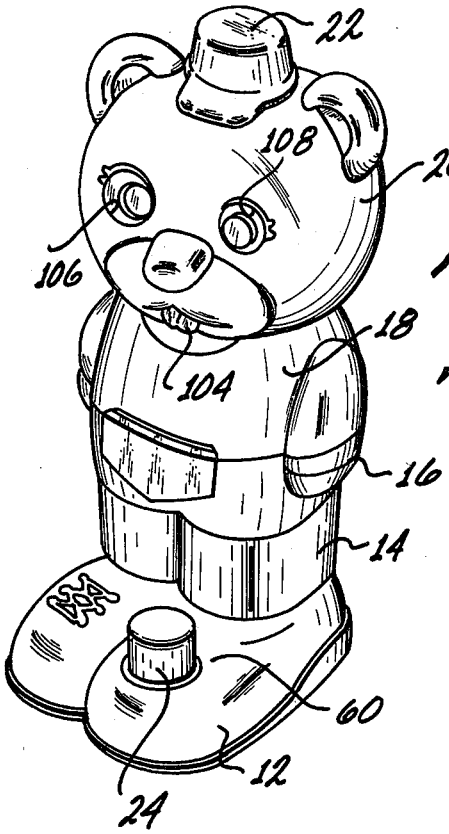
FIG. 1 is an oblique view showing the illustrative embodiment of the invention.

The invention described in this specification and illustrated in the drawings utilizes certain principles and/or concepts as are set forth and claimed in the claims appended to this specification. Those skilled in the toy arts will realize that these principles and/or concepts are capable of being expressed in a variety of embodiments differing from the embodiments utilized for illustrative purposes herein. For this reason this invention is not to be construed as being limited to the exact embodiment illustrated herein, but is to be construed only in light of the claims.

DETAILED DESCRIPTION

Figure 2:
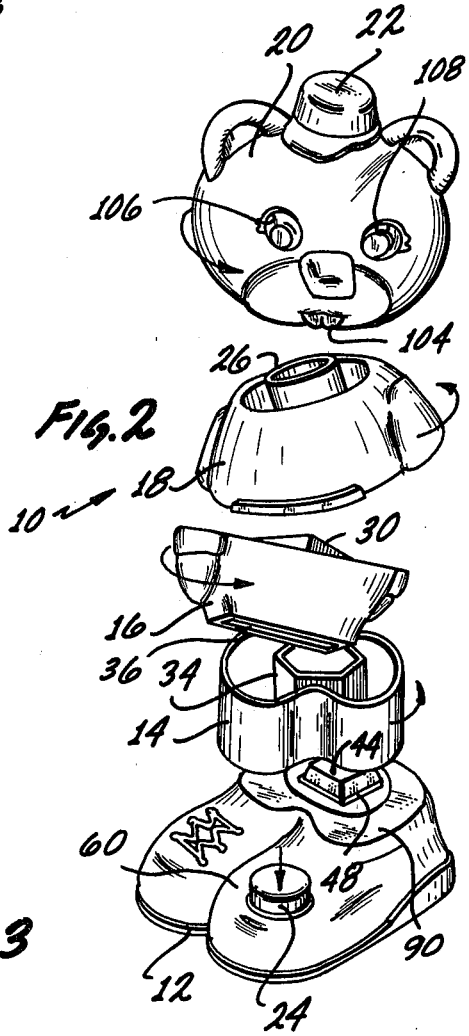
FIG. 2 is an exploded view of the toy of FIG. 1 with certain of the elements rotated from their position seen in FIG. 1.
Figure 3:
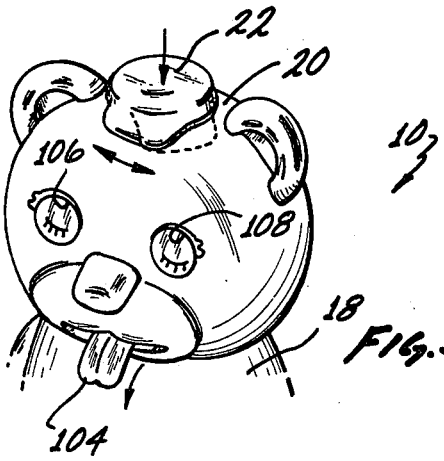
FIG. 3 is an oblique view of the top portion of the toy as seen in FIG. 1 with certain of the components of the toy in FIG. 1 in a different spacial relationship with respect to one another than as seen in FIG. 1.

Before describing the individual components of the invention, a brief description of its operation will help in understanding of the individual components. Referring now to FIGS. 1, 2 and 3, the toy 10 of the invention is composed, in a gross overview, of a base portion 12, a leg portion 14, a lower torso portion 16, an upper torso portion 18 and a head portion 20. Each of the portions 12, 14, 16, 18 and 20 connect with the immediate adjacent portions via couplings utilizing certain geometric structures as hereinafter explained.

In playing with the toy 10, the child assembles the above noted components one upon the other to form the toy as seen in FIG. 1. These components can only be assembled in one particular order because of the geometrical linkages alluded to above. When successfully assembled, the toy represents a small characterized animal such as the bear seen in FIG. 1. If the child desires, the toy can be made to issue a squeaking sound, the eyes blink from an open position to a closed position and concurrently the tongue extends out of the mouth by depression of the central cap area 22 on top of the head component 20. Further enumeration of these parts will be explained below.

After the child has successfully assembled the toy, the child can, by depressing button 24 located in the base section 12, cause the components 14, 16, 18 and 20 to spin with respect to the base 12 in a clockwise direction. When these components are caused to be spun by depression of the button 24, they become disassembled from one another and disassembled from the base. The child is now required to reassemble the components back into the structure as it is seen in FIG. 1 and play can resume.

The head 20 is mounted onto the upper torso section 18 by insertion of a circular boss 26 on the upper torso portion 18 to an appropriate circular hole 28 in the bottom surface (not separately numbered or identified) of the head 20. The upper torso 18 is connected to the lower torso 16 by insertion of a triangular-shaped boss 30 on lower torso 16 into a slightly larger hollow triangular-shaped boss 32 on the bottom of the upper torso 18. The lower torso 16 in turn is attached to the legs 14 by insertion of a hexagon-shaped boss 34 on the legs component 14 into an appropriate hexagon-shaped boss 36 on the lower part of lower torso 16.

Because the head 20 is attached to the upper torso 18 via a circular boss 26 fitting into a circular hole 28, the head 20 is free to spin on the upper torso 18 and the child can so spin the head while playing the movable components of the head and the noisemaker located therein as hereinafter described. Contrary to this, the lower and upper torsos 16 and 18 can only be correctly assembled with respect to one another in one orientation because of the triangular connection between them. The legs 14 can be assembled to the lower torso 16 with two orientations because of the hexigon-shaped connection; however, only one of these is correct and the child in playing with the toy soon learns this. If in fact the lower torso 16 is assembled to the legs 14 when the legs are not on the base 12, the child could inappropriately put the legs on backwards. When the legs were then assembled to the base 12 the child would discover his error and would then have to correct it. This requires that the child learn to take into account the lower connection on the legs 14 with the base 12 as well as its upper connection with the lower torso 16 in assembling the toy. This fact is easily discovered by the toddler-aged child.

Figure 4:
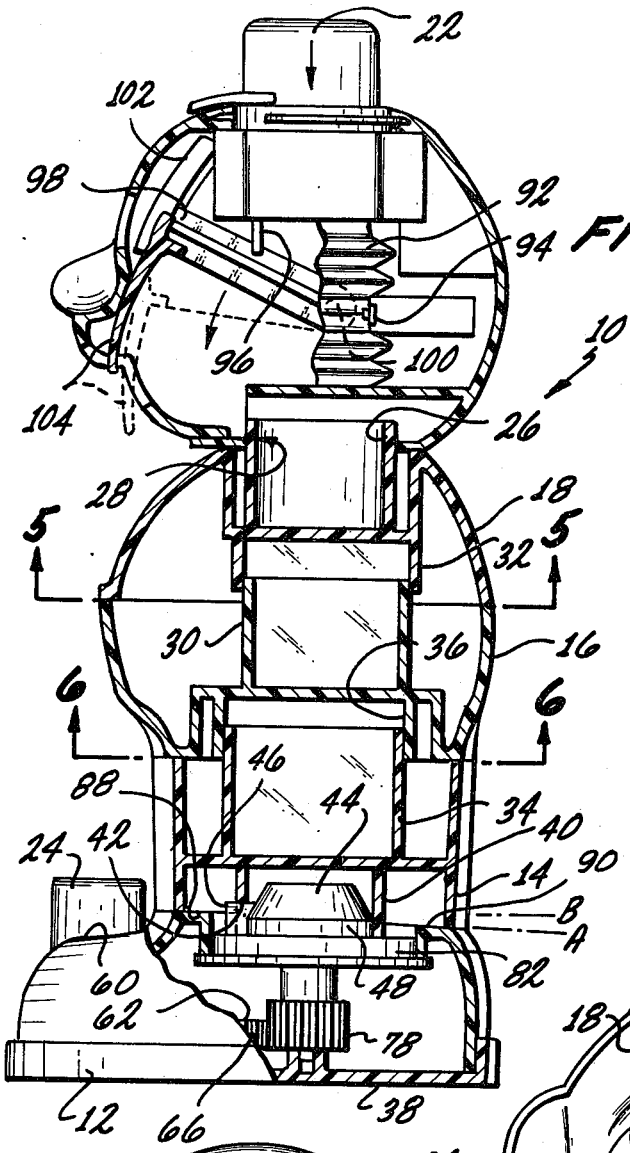
FIG. 4 is a side elevational view in partial section of the toy of FIG. 1.
Figure 5:
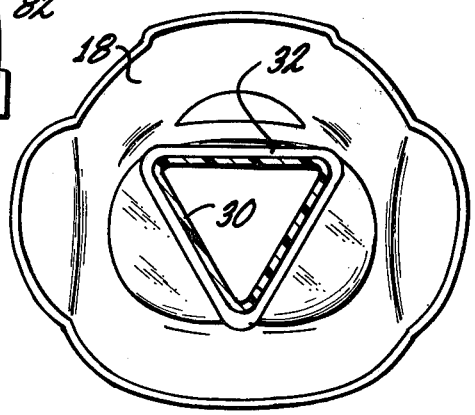
FIG. 5 is a plan view in partial section about the line 5—5 of FIG. 4.
Figure 6:
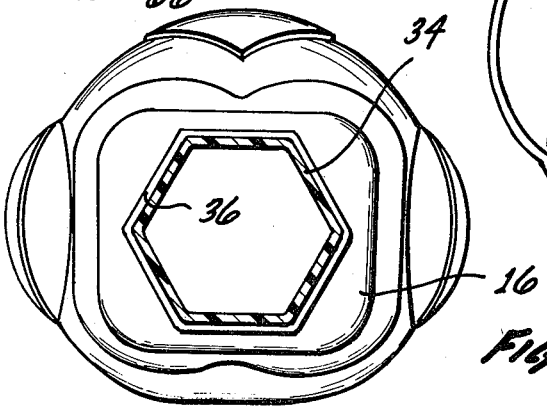
FIG. 6 is a plan view in partial section about the line 6—6 of FIG. 4.

In FIG. 4 to the right of the base 12 and the legs 14, are lines A and B. Line A is an extension of the joint between the legs 14 and the base 12 and line B represents a line which is parallel to the bottom 38 of the base 12 and perpendicular to the axis of rotation of connector 44. As can be seen in viewing lines A and B, the connection between the legs 14 and the base 12 is not parallel to the bottom 38 of the base 12, but is in fact inclined thereto and is also inclined to the axis of rotation of connector 44. When the leg 14 is properly seated on the base 12 the remaining components 16, 18 and 20 will be stacked along the line or axis which is perpendicular to the bottom 38 of the base 12. If in fact the leg component 14 is rotated 180 degrees with respect to as it is seen in FIG. 4, the axis of rotation of the legs 14 as well as the components 16, 18 and 20 would not lie in a line perpendicular with the base 12, but would be inclined at an angle from this perpendicular line toward the right hand side of FIG. 4. When all of the components 14, 16, 18 and 20 are assembled together and if they are rotated 180 degrees with respect to the base 12, as noted in the preceeding sentence, the center of gravity of the components 14, 16, 18 and 20 taken as a unit would be displaced beyond a line perpendicular to the edge (not numbered or identified) of the base 12 such that these components would topple under the influence of gravity off of the base 12. The significance of this will be evident below.

Figure 7:
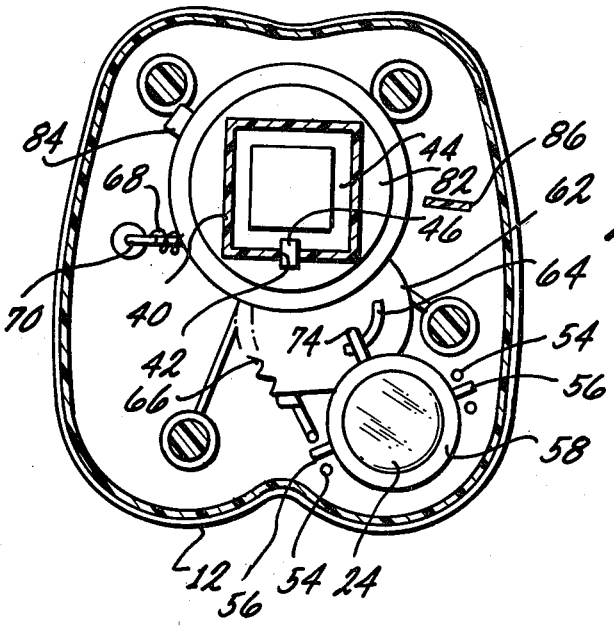
FIG. 7 is a top plan view of the bottommost area of the toy of FIG. 2 with a housing component removed to expose the internal components.

Extending out of the bottom of the leg component 14 is a square-shaped boss 40. Portions of this boss 40 are also seen in FIG. 7. The boss 40 contains a slot 42. Projecting upwardly from the base 12 is a truncated square pyramid-shaped connector 44. This connector contains a key 46 projecting out of one of its faces. The key is adapted to fit into the slot 42 when the connector 44 fits within the square boss 40 in a reentrant manner. Around the base of the connector 44 is a wall 48 which is square in shape and forms an intimate connection with the square boss 40 when the legs 14 are properly located on the base 12. This, along with the interaction of the key 46 with the slot 42, maintains the legs 14 properly seated on the base 12 and allows communication of rotation of the connector 44 to the legs 14.

Figure 8:
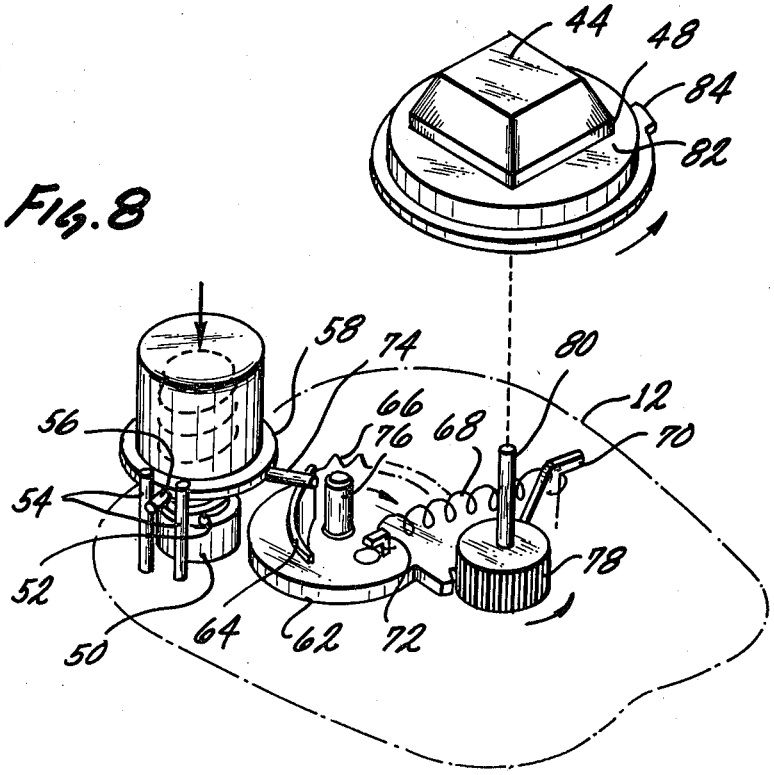
FIG. 8 is an oblique view of some of the components seen in FIG. 7 with one of the components exploded to show functioning of the components underneath.

Referring now to FIGS. 7 and 8 within the base 12, the following components are located. Button 24 fits over an upstanding boss 50 a portion which can be seen in FIG. 8 and is biased upwardly by a spring 52 fitting around the boss 50 beneath the hollow interior of the button 24. Guide posts collectively identified by the numeral 54 projecting upwardly from the base 12 and interacting with guideposts 56 located on the button 24 keeping the button from rotating about the boss 50. A flange 58 extends from the lowermost periphery of the button 24 and prevents the button 24 from being pushed by spring 52 through the upper housing 60 of the base 12.

Located to one side of the button 24 is a rotating member 62 having a cam surface 64 and an arcuate gear rack 66 formed as a part of it. A spring 68 fitting between a projection 70 on the base 12 and a projection 72 on the member 62 biases the member 62 in a counterclockwise direction.

Projecting out of flange 58 over the cam surface 64 is a cam follower 74. This cam follower 74 acts with the cam surface 64 when the button 24 is depressed causing rotation of the member 62 in a clockwise direction against the bias of spring 68 about boss 76 on which member 62 rotates.

Located to the right in FIG. 8 of the member 62 is a gear 78 appropriately mounted about an axel 80. The gear 78 is keyed (not shown in the FIGS.) to the bottom of disk 82 on which connector 44 is intricately formed. Rotation of the gear 78 is thus transferred to disk 82 rotating the connector 44. It can thus be seen that depression of the button 24 ultimately results in counterclockwise rotation of the connector 44.

The disk 82 includes a stop 84 located on its periphery which interacts with an upstanding boss 86 which is used to connect the upper housing 60 to the base 12. Additional other bosses similar in function to the boss 86 are shown in FIG. 7; however, they are not numbered or described, their function being exactly equivalent. The interaction of the stop 84 with the boss 86 correctly aligns the key 46 to the front of the base 12 such that when the leg component 14 is correctly located on the base 12 the slot 42 correctly lines up with the key 46 and the lower surface 88 of the leg component 14 is appropriately mated on the upper surface 90 of the base 12. This appropriately initially orients all of the components 14, 16, 18 and 20 directly on a perpendicular with the bottom 38 of the base 12.

When the button 24 is depressed the connector 44 rotates very rapidly about its axis of rotation and if the components 14, 16, 18 and 20 are stacked on the base 12 they also rotate rapidly. This induces an angular momentum into the components 14, 16, 18 and 20. When the components 14, 16, 18 and 20 are located on the base 12, as per FIG. 1, the axis of rotation of the connector 44 coincides with the axis of rotation of the other collective components; however, as the components 14, 16, 18 and 20 rotate towards the 180 degree position, with respect to the base 12, the axis of rotation of the components 14, 16, 18 and 20 is caused to incline away from the axis of rotation of the connector 44 because of the inclination of the connection between the lower surface 88 of the leg component 14 and upper surface 90 of the base 12 with respect to the bottom 38 of the base 12.

In the first instance when the components 14, 16 18 and 20 are stacked onto the base 12, as in FIG. 1, these components are in a first position and the initial axis of rotation of all of these components as well as the axis of rotation of the connector 44 coincide with a line perpendicular to the bottom 38 of the base 12. When the button 24 is depressed and the components 14, 16, 18 and 20 are caused to rotate, their axis of rotation inclines and becomes misaligned with the perpendicular line to the bottom 38 and the axis of rotation of connector 44. Because of the angular momentum induced into these components 14, 16, 18 and 20, as they are spun by depressing the button 24 as well as the inclination of their axis of rotation they are caused to disengage with one another and with the base 12. This disengagement is further assisted by the above dislocation of the center of gravity of the components 14, 16, 18 and 20 when these components are caused to rotate 180 degrees from their position as shown in FIG. 1.

In effect, the lower surface 88 of the component 14 and the upper surface 90 of the component 12 are cam surfaces, one against the other. When the leg component 14 is aligned, as seen in FIG. 1, the interaction of these surfaces aligns the upright axis of the component 14 vertically and when they are rotated 180 degrees the interaction of these surfaces causes the axis of component 14 to deviate from true vertical. It is obvious that in place of having the totality of surfaces 88 and 90 shaped as these cam surfaces, a smaller cam surface projecting from the leg 14 and a similar interacting one from the base 12 would serve the same effect. In view of simplicity of construction and operation, however, it is preferred to have the total surfaces 88 and 90 shaped as they are to form the cam surfaces.

Located in the head and independent of any function herein described, is the cap button 22. The cap button 22 fits over a bellows 92 and when the cap button 22 is depressed, the bellows is compressed causing air to exit via a whistle 94 incorporated into the side of the bellows. The bellows is an imperforate structure except for the whistle 94, thus compression of the bellows 92 causes air to be discharged via the whistle 94 causing a whistling sound.

On the underneath side of the cap 22 is an extension 96. This extension 96 interacts with a lever 98 which is pivoted about pins 100 to the head 20. On the other end of lever 98 is an arcuate-shaped member 102 on which a set of both open eye and closed eye indicia are printed. A tongue 104 is formed as the lowermost portion of member 102. When the cap 22 is depressed, the extension 96 interacts with the lever 98 pivoting it about pins 100 moving the member 102 downwardly to extend the tongue 104 from the interior of the head 20 to an exterior position and at the same time move the open eye indicia through the openings 106 and 108. It is noted that the head 20 can be removed from all of the components herein described and the child can simple use it as a squeaker toy which will close its eyes and stick out its tongue when it is squeaked.

I claim:

1. A toy which comprises:

a first member;

rotation means associated with said first member, at least a portion of said rotation means capable of rotating with respect to said first member at a first axis of rotation;

a second member capable in a first instance of being associated with said first member;

coupling means detachably coupling said second member to said rotating portion of said rotation means so as to transfer rotary movement of said rotating portion of said rotation means to said second member to rotate said second member with respect to said first member through a portion of one rotation;

said rotation of said second member with respect to said first member comprises rotation about a second member axis of rotation, said second member axis of rotation coincidental with said first axis of rotation in said first instance;

means located on one of said first or said second members and capable of interacting with the other of said first or said second members to incline the axis of rotation of said second member with respect to said first axis of rotation in response to said second member rotating through a portion of one rotation with respect to said first member such that in a second instance in response to said second member rotating through said portion of one rotation and said axis of rotation of said second member being inclined with respect to said first axis of rotation said second member is capable of disassociating from said first member.

2. The toy of claim 1 wherein:

said means capable of inclining said axis of rotation of said second member includes one of said first or said second members including a surface essentially lying in a plane which is inclined with respect to a plane perpendicular to said first axis of rotation.

3. The toy of claim 2 wherein:

both of said first and said second members include a surface essentially lying in a plane which is inclined with respect to a plane perpendicular to said first axis of rotation.

4. The toy of claim 3 wherein:

said surfaces on said first and said second members are slidably movable with respect to one another as said second member rotates with respect to said first member, said axis of rotation of said second member inclining with respect to said first axis of rotation as said surfaces move with respect to one another.

5. The toy of claim 4 including:

a plurality of other members reversibly capable of being associated with said second member and capable of being supported by said second member in a first instance such that said second member and said plurality of other members form a unified structure in said first instance and said second member and said plurality of other members are capable of being disassociated from said second member in said second instance.

6. The toy of claim 1 including:

a plurality of other members reversibly capable of being associated with said second member and capable of being supported by said second member in said first instance such that said second member and said plurality of other members form a unified structure in said first instance and said second member and said plurality of other members are capable of being disassociated from said second member in said second instance.

7. A toy which comprises:

a plurality of at least three members, each of said members including associating means capable of reversibly associating each of said members with at least one of the other of said plurality of members such that said plurality of members are capable of being reversibly associated together to form a unified structure;

one of said plurality of said members including rotation means, said rotation means capable of rotating the remainder of said plurality of members with respect to said one of said members when said plurality of said members are associated together into said unified structure;

destabilizing means located on one of said plurality of members, said destabilizing means including an inclination member, said destabilization means destabilizing said association of said one of said members with any of the other of said plurality of members with which it is associated in response to rotation through a portion of one rotation of the remainder of said plurality of members with respect to said one of said members and concurrently with said rotation, inclination of the remainder of said plurality of members with respect to said one of said members in response to interaction of one of said members with said inclination member.

8. The toy of claim 7 wherein:

said one of said members comprises a base member and the other of said members associated with said base member by forming a vertical stack one upon the other to form said unified structure.

9. The toy of claim 8 wherein:

said base member includes a bottom surface and a top surface, said vertical stack of said other member supported on said top surface and aligning about an axis perpendicular to said base member, at least a portion of said top surface inclined with respect to the plane of said bottom surface.

* * * * *